US010770225B2

(12) United States Patent
Dardona et al.

(10) Patent No.: US 10,770,225 B2
(45) Date of Patent: Sep. 8, 2020

(54) MULTILAYERED COILS

(71) Applicant: Hamilton Sundstrand Corporation, Charlotte, NC (US)

(72) Inventors: Sameh Dardona, South Windsor, CT (US); Paul Sheedy, Bolton, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 98 days.

(21) Appl. No.: 15/231,304

(22) Filed: Aug. 8, 2016

(65) Prior Publication Data

US 2018/0040419 A1 Feb. 8, 2018

(51) Int. Cl.

| | |
|---|---|
| ***H01F 5/00*** | (2006.01) |
| ***H01F 41/04*** | (2006.01) |
| ***H01F 17/00*** | (2006.01) |
| ***H01F 27/02*** | (2006.01) |
| ***H01F 27/28*** | (2006.01) |

(52) U.S. Cl.

CPC ..... *H01F 41/041* (2013.01); *H01F 5/00* (2013.01); *H01F 17/0013* (2013.01); *H01F 27/02* (2013.01); *H01F 27/2804* (2013.01); *H01F 2017/002* (2013.01); *H01F 2027/2809* (2013.01)

(58) Field of Classification Search

CPC ..... H01F 5/00; H01F 5/03; H01F 27/2804; H01F 2017/002; H01F 2027/2809; H01F 27/00–36

USPC ..... 336/65, 83, 196, 200, 206–208, 232

See application file for complete search history.

(56) References Cited

U.S. PATENT DOCUMENTS 4,873,757 A * 10/1989 Williams ..... H01F 17/0013 29/602.1
5,312,674 A * 5/1994 Haertling ..... H01L 23/055 252/62
5,499,005 A 3/1996 Gu et al.
5,521,573 A * 5/1996 Inoh ..... H01F 27/2804 336/180
5,952,909 A * 9/1999 Umeno ..... H01F 17/0013 29/602.1

(Continued)

FOREIGN PATENT DOCUMENTS

KR 101328640 B1 11/2013

OTHER PUBLICATIONS

Extended European Search Report dated Feb. 14, 2018, issued during the prosecution of European Patent Application No. EP 17184451.7 (7 pages).

(Continued)

*Primary Examiner* — Tuyen T Nguyen

(74) *Attorney, Agent, or Firm* — Locke Lord LLP; Scott D. Wofsy; Joshua L. Jones

(57) ABSTRACT

A method of producing electrical coils includes preparing a plurality of coil layers. Each coil layer is prepared by printing an electrically conductive coil pattern on a layer substrate. Each coil pattern includes an inner end at a first via through the substrate at a point radially inside the coil pattern, and an outer end at a second via through the substrate at a point radially outside the coil pattern. The method also includes joining the coil layers into a stack and electrically connecting successive coil patterns of the plurality of coil layers to one another through the vias to form a conductive coil extending through the stack.

19 Claims, 3 Drawing Sheets

(56) References Cited

U.S. PATENT DOCUMENTS

| | | | | |
|---|---|---|---|---|
| 6,054,914 | A * | 4/2000 | Abel | H01F 1/344 336/200 |
| 6,198,374 | B1 * | 3/2001 | Abel | H01F 17/0013 336/200 |
| 7,212,095 | B2 | 5/2007 | Sato et al. | |
| 8,525,646 | B2 | 9/2013 | Tamm et al. | |
| 9,087,636 | B2 | 7/2015 | Kostelnik et al. | |
| 2012/0249276 | A1 | 10/2012 | Fontana et al. | |
| 2016/0035473 | A1 | 2/2016 | Freakes | |

OTHER PUBLICATIONS

European Communication Pursuant to Article 94(3) EPC, dated Oct. 9, 2018, issued during the prosecution of corresponding European Patent Application No. EP 17184451.7.

* cited by examiner

MULTILAYERED COILS

BACKGROUND OF THE INVENTION

1. Field of the Invention

The present disclosure relates to electrical components, and more particularly to electromagnetic such as used in inductors, motors, actuators and the like.

2. Description of Related Art

Electromagnetic coils are pervasive in electrical and electromechanical (EM) systems. These components are often manufactured using lamination and winding or etching of electrical conductors. The materials in the assembly are traditionally selected for specific properties (e.g. electrical or thermal conductivity, dielectric strength, or magnetic permeability) and the three dimensional organization of these materials is critical to optimization of device performance.

However, with conventional methods, optimum device designs are theoretical only and are often not manufacturable. Performance is then sacrificed due to processing constraints. One example is the less than 100% copper fill factor in motor winding slots due to physical constraints of the winding process. Another example is the local heating due to low thermal conductivity substrates and insulating polymers. Use of additive manufacturing (AM) methods significantly reduces the manufacturing design constraints for electromagnetic devices. Preliminary explorations of AM for EM devices have yet to find effective methods to fully integrate electrical function with mechanical structure.

Such conventional methods and systems have generally been considered satisfactory for their intended purpose. However, there is still a need in the art for improved electromagnetic coils. The present disclosure provides a solution for this need.

SUMMARY OF THE INVENTION

A method of producing electrical coils includes preparing a plurality of coil layers. Each coil layer is prepared by printing an electrically conductive coil pattern on a layer substrate. Each coil pattern includes an inner end at a first via through the substrate at a point radially inside the coil pattern, and an outer end at a second via through the substrate at a point radially outside the coil pattern. The method also includes joining the coil layers into a stack and electrically connecting successive coil patterns of the plurality of coil layers to one another through the vias to form a conductive coil extending through the stack.

The layer substrates can include a ceramic material. Each layer substrate can be 20 microns or less in thickness. Printing an electrically conductive coil pattern can include printing the coil pattern on the layer substrate with conductive ink, and thermally heat or laser treating the conductive ink to enhance electrical conductivity in the coil pattern.

For each successive pair of coil layers, the coil patterns can connect to each other by at least one of the first vias of each of the coil layers in the pair or the second vias of each of the coil layers in the pair. Successive pairs of inner vias can be joined at a first inner via location that shifts with each successive pair. Successive pairs of outer vias can be joined at a second via location that shifts with each successive pair. The vias can be respectively filled with conductive ink to establish electrical connections between successive coil patterns.

Every other coil pattern can wind clockwise from the outer end to the inner end thereof, and each remaining coil pattern can wind clockwise from the inner end thereof to the outer end thereof so that there is a common coil winding direction throughout the stack. 80% or more of the volume of the stack can be occupied by the coil patterns.

The coil pattern can be wound in a clockwise direction to produce a downward pointing magnetic field. It is also contemplated that the coil pattern can be wound counter-clock-wise to produce an upward oriented magnetic field.

An electrical coil includes a stack of coil layers. Each coil layer includes a layer substrate with an electrically conductive coil pattern thereon. Each coil pattern includes an inner end at a first via through the substrate at a point inside the coil pattern, and an outer end at a second via through the substrate at a point outside the coil pattern. Each of the coil layers is joined to the stack with successive coil patterns connected to one another through the vias to form a conductive coil extending through the stack. Each of the substrates is identical, e.g., with a plurality of first vias and a plurality of second vias. At least two of the coil patterns can differ from one another. The coil patterns can vary from coil layer to coil layer with respect to at least one of: the inner end of the coil pattern being located at a different one of the first vias of its substrate with each successive pair of coil layers, or the outer end of the coil pattern being located at a different one of the second vias of its substrate with each successive pair of the coil layers.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
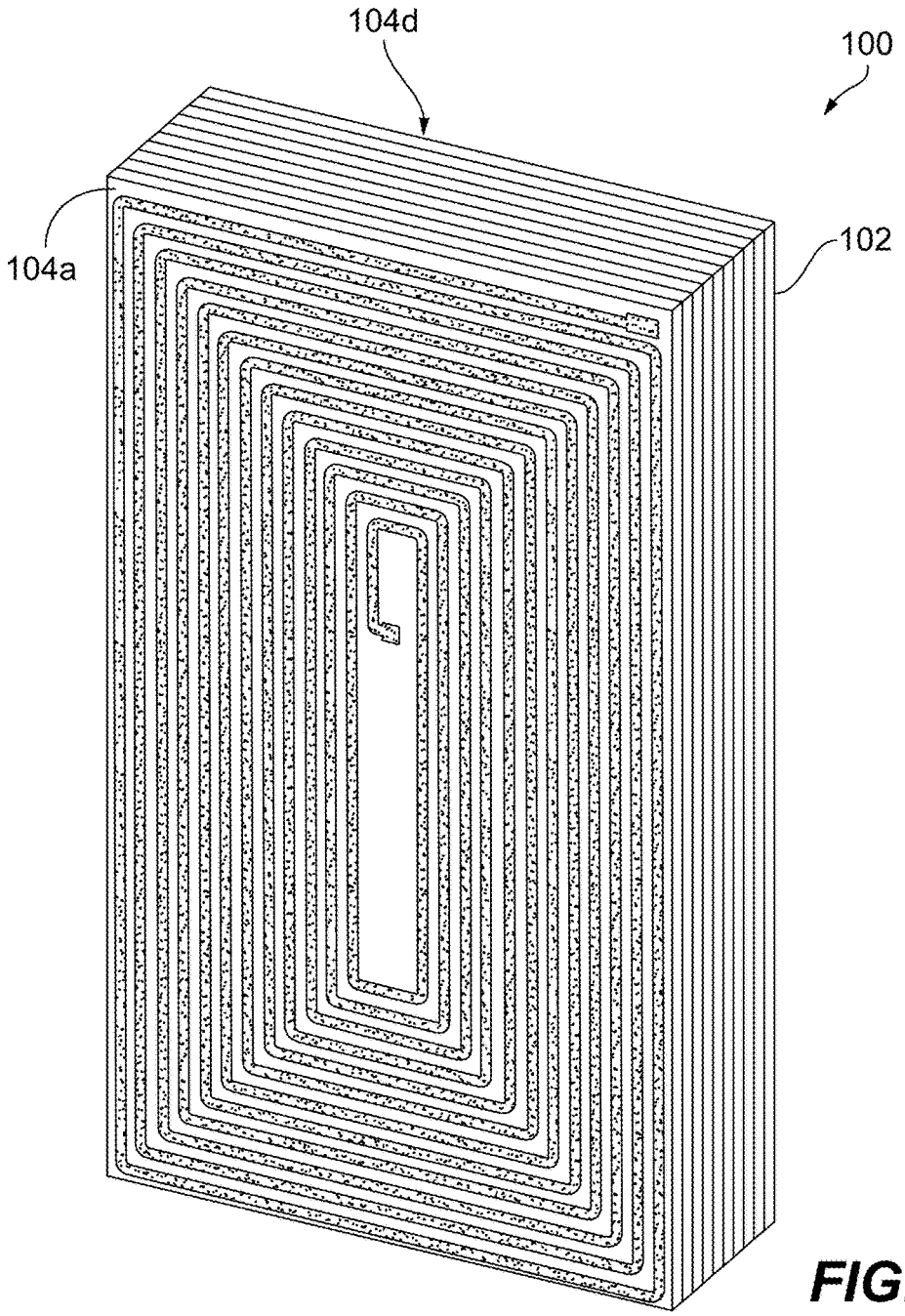
FIG. 1 is a schematic perspective view of an exemplary embodiment of an electrical coil constructed in accordance with the present disclosure, showing a stack of electrically connected coil layers.

Reference will now be made to the drawings wherein like reference numerals identify similar structural features or aspects of the subject disclosure. For purposes of explanation and illustration, and not limitation, a partial view of an exemplary embodiment of an electrical coil in accordance with the disclosure is shown in FIG. 1 and is designated generally by reference character 100. Other embodiments of electrical coils in accordance with the disclosure, or aspects thereof, are provided in FIGS. 2-3, as will be described. The systems and methods described herein can be used to produce electrical coils for use in electrical and electromechanical systems, such as inductors, motors, actuators, and the like.

Figure 2:
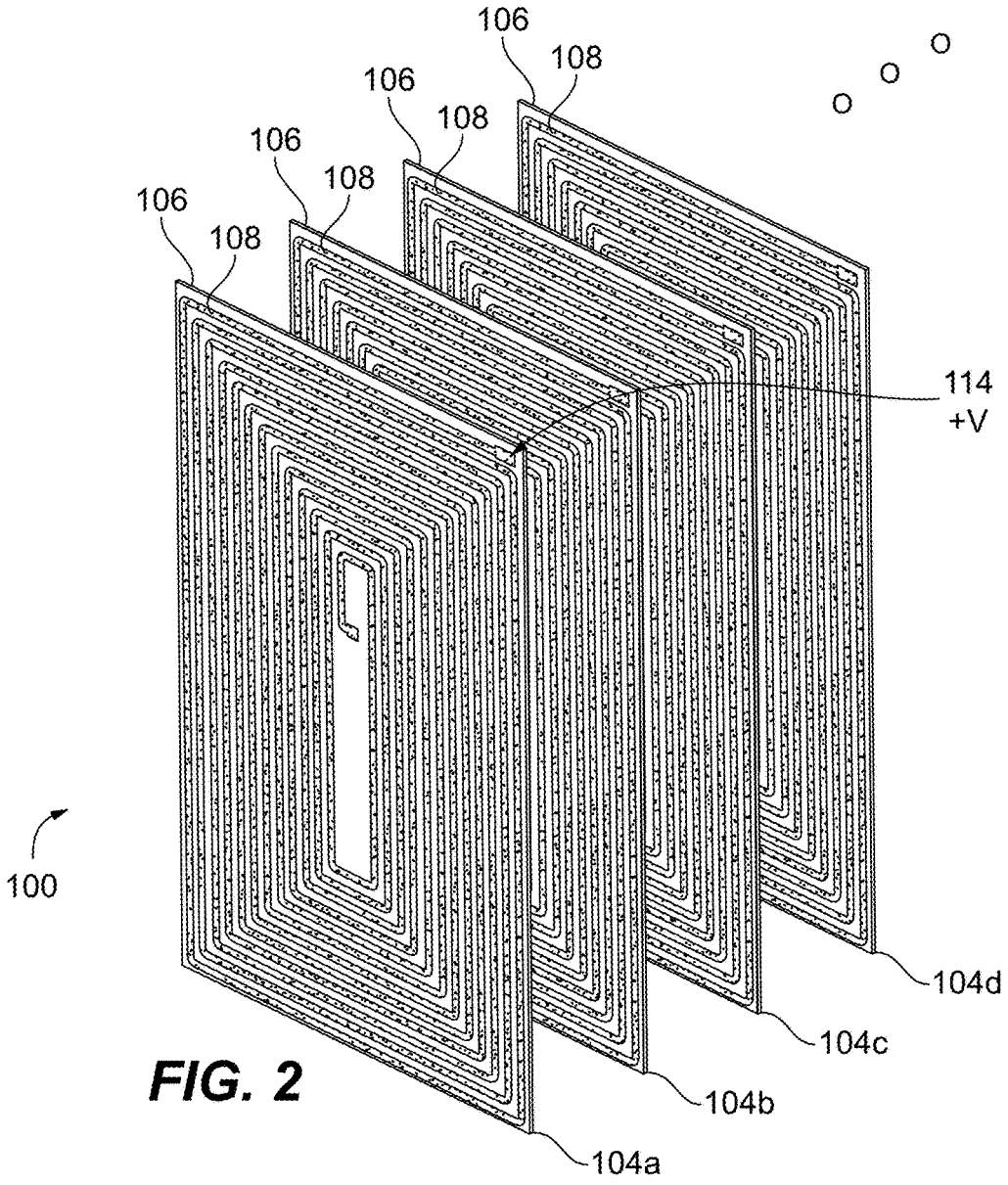
FIG. 2 is a schematic exploded perspective view of the electrical coil of FIG. 1, showing the coil layers separated.
Figure 3:
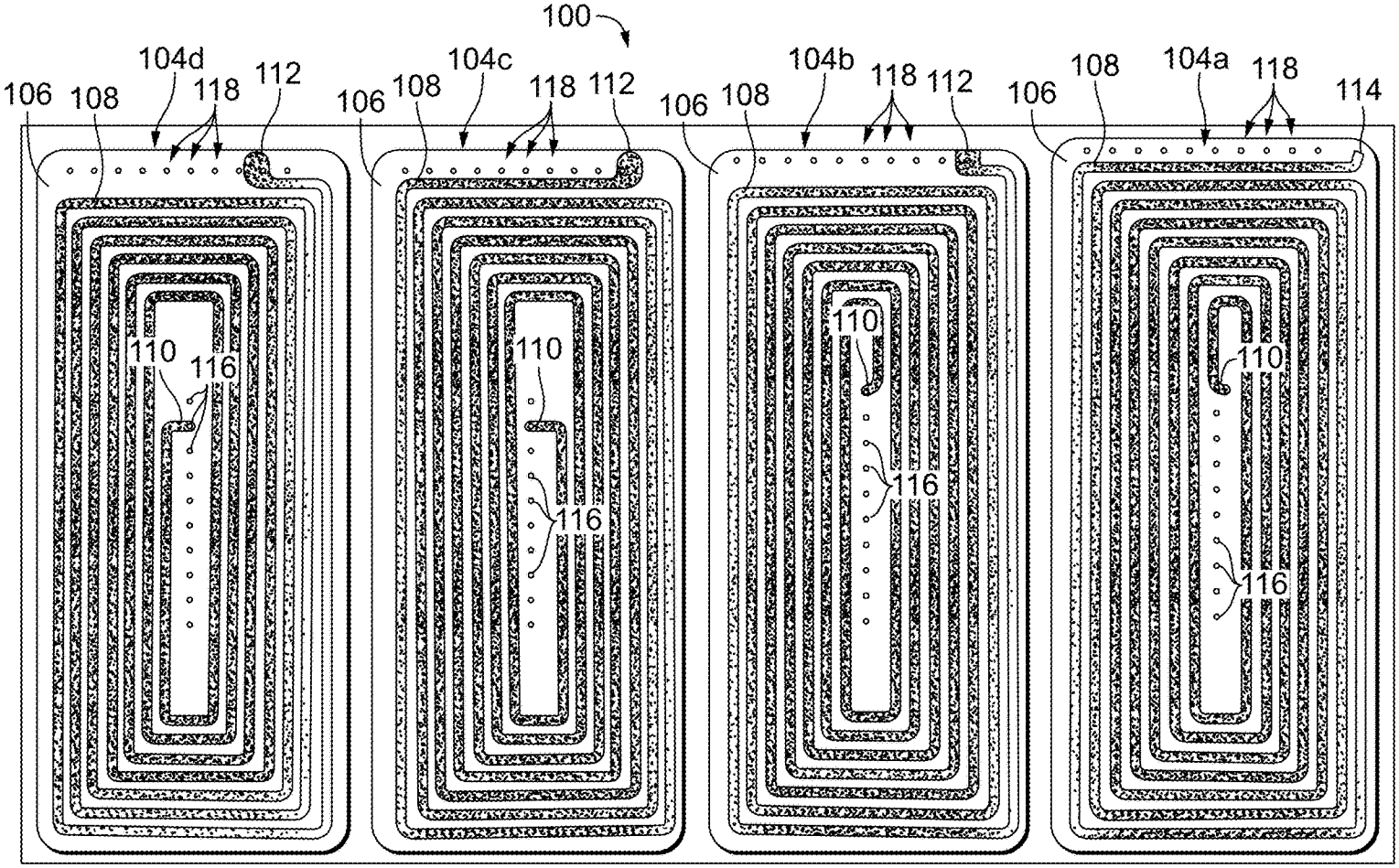
FIG. 3 is a schematic plan view of the coil layers of FIG. 2, showing each coil layer prior to stacking.

An electrical coil 100 includes a stack 102 of coil layers 104*a*, 104*b*, 104*c*, and 104*c*, which are shown separately in FIG. 2. Those skilled in the art will readily appreciate that while four coil layers are shown and described herein for the sake of clarity, any suitable number of coil layers can be used in a stack without departing from the scope of this disclosure, as indicated by the ellipses in FIG. 2. The more layers are used, the greater the magnetic field strength that can be produced. Each coil layer 104*a*, 104*b*, 104*c*, and 104*d* includes a respective layer substrate 106 with an electrically conductive coil pattern 108 thereon. As shown in FIG. 3, each coil pattern 108 includes an inner end at a first via 110 through the substrate 106 at a point radially inside the coil pattern 108. Each of coil layers 104*b*, 104*c*, and 104*d* includes an outer end at a second via 112 through the substrate 106 at a point radially outside the coil pattern 108. In the case of coil layer 104*a*, the outer end of the coil pattern 108 is a voltage take off 114. Each of the coil layers 104*a*, 104*b*, 104*c*, and 104*d* is joined to the stack 102 as shown in FIG. 1, with successive coil patterns connected to one another through the vias 110 and 112 to form a conductive coil extending through the stack 102.

A method of producing electrical coils, e.g., electrical coil 100, includes preparing a plurality of coil layers, e.g., coil layers 104*a*, 104*b*, 104*c*, and 104*d* as shown in FIG. 3. Each coil layer is prepared by printing an electrically conductive coil pattern, e.g. coil patterns 108, on a layer substrate, e.g. layer substrate 106. Each coil pattern includes an inner end at a first via, e.g., vias 110, through the substrate at a point inside the coil pattern, and an outer end at a second via, e.g., vias 112, through the substrate at a point outside the coil pattern. The method also includes joining the coil layers into a stack, e.g. stack 102 of FIG. 1, wherein successive coil patterns are connected to one another through the vias to form a conductive coil extending through the stack.

With continued reference to FIG. 3, the layer substrates 106 include a ceramic material. The ceramic material can include magnetic materials to function as a magnetic core in addition to supporting the coil layer. Each layer substrate 106 is 20 microns or less in thickness. Printing an electrically conductive coil pattern includes printing the coil patterns 108 on the layer substrates 106 with conductive ink, e.g. using a direct write process such as ink jet printing, aerosol, extrusion, or spraying powders using thermal plasma (meso-plasma) or micro-cold spray methods, and heat treating the conductive ink to enhance electrical conductivity in the coil patterns 108. Any suitable process can be used, such as thermal curing/sintering at high temperature for stability at operational temperature. The conductive ink can be of any suitable type, e.g., high conductivity metal ink formulations.

For each successive pair of coil layers 108 in the stack 102, the coil patterns 108 connect to each other by at least one of the first vias 110 of each of the coil layers 104*a*, 104*b*, 104*c*, and 104*d* in the pair. For example, coil layers 104*c* and 104*d* connect to each other through their respective vias 110, as do coil layers 104*a* and 104*b*. In the alternating parings, the second vias 112 of each of the coil layers 104*a*, 104*b*, 104*c*, and 104*d* in the pair connect adjacent coil layers 104*a*, 104*b*, 104*c*, and 104*d*. For example, the pair of coil layers 104*b* and 104*c* connect electrically to each other through their respective vias 112. Coil layer 104*d* could connect to an additional coil layer through its via 112, and so forth. The vias 110 and 112 can all be formed by laser drilling, micro-machining, or any other suitable process, and are respectively filled with conductive ink to establish electrical connections between successive coil patterns 108. This connection ultimately forms a single coil from the take off 114 to the via 112 of coil layer 104*d*.

With continued reference to FIG. 3, every other coil pattern 104*b* and 104*d* winds clockwise from the outer end to the inner end thereof, and each remaining coil pattern 104*a* and 104*c* winds clockwise from the inner end thereof to the outer end thereof so that there is a common coil winding direction throughout the stack 102. This arrangement allows for 80% or more of the volume of the stack 102 to be occupied by the coil patterns 104*a*, 104*b*, 104*c*, and 104*d*.

The coil patterns can be wound in a clockwise direction to produce a downward pointing magnetic field, as oriented in FIG. 3. It is also contemplated that the coil patterns can be wound counter-clock-wise to produce an upward oriented magnetic field, as oriented in FIG. 3.

Additionally, Each of the substrates can be identical, e.g., with a plurality of first vias and a plurality of second vias. At least two of the coil patterns can differ from one another. The coil patterns can vary from coil layer to coil layer with respect to at least one of: the inner end of the coil pattern being located at a different one of the first vias of its substrate with each successive pair of coil layers, or the outer end of the coil pattern being located at a different one of the second vias of its substrate with each successive pair of the coil layers. Successive pairs of inner vias 110 are joined at a first inner via location 116 that shifts, e.g., is in a different location, with each successive pair. For example coil layers 104*c* and 104*d* have their inner vias at the second highest via location 116 (as oriented in FIG. 3), whereas coil layers 104*a* and 104*b* have their inner vias at the highest via location 116 (as oriented in FIG. 3). This avoids interference or short circuiting between successive pairs of the coil layers. Successive pairs of outer vias 112 are joined at a second via location 118 that shifts, e.g., is different, with each successive pair. For example, coil layers 104*b* and 104*c* are joined electrically at the right most via location 118 (as oriented in FIG. 3), and coil layer 104*d* and the next layer (not pictured), would be joined at the second to the right most via location 118 (as oriented in FIG. 3).

Beyond relaxing design constraints, additive manufacturing, and particularly using flexible and thin substrates with high magnetic permeability, allows for the departure from the traditional wire winding manufacturing and brings the potential for significant cost reduction due to rapid production and a higher level of integration and automation. Those skilled in the art will readily appreciate that while the stack 102 has been shown as a rectangular prism, techniques as described herein can be used to customize a stack of coil layers to fit any suitable envelope shape.

The methods and systems of the present disclosure, as described above and shown in the drawings, provide for electrical coils with superior properties including departure from the limitations of traditional wire windings. For example, greater concentricity can now be obtained than with traditional wire windings. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. An electrical coil comprising:

a stack of coil layers, wherein at least two of the coil layers each include:

a layer substrate with an electrically conductive coil pattern thereon, wherein each coil pattern includes an inner end at a first via through the substrate at a point inside the coil pattern, and an outer end at a second via through the substrate at a point outside the coil pattern;

wherein each of the coil layers is joined to the stack with successive coil patterns connected to one another through the vias to form a conductive coil extending through the stack, wherein each successive pair of inner vias are joined to one another at a respective inner via location that is varied from pair to pair in the stack of coil layers so no two pairs of coil layers are short circuited to one another through the vias.

2. An electrical coil as recited in claim 1, wherein for each successive pair of coil layers, the coil patterns connect to each other by at least one of the first vias of each of the coil layers in the pair or the second vias of each of the coil layers in the pair.

3. An electrical coil as recited in claim 1, wherein each conductive coil pattern includes conductive ink, heat treated for electrical conductivity.

4. An electrical coil as recited in claim 1, wherein the layer substrates include a ceramic material.

5. An electrical coil as recited in claim 1, wherein each layer substrate is 20 microns or less in thickness.

6. An electrical coil as recited in claim 1, wherein 80% or more of the volume of the stack is occupied by the coil patterns.

7. An electrical coil as recited in claim 1, wherein the vias are respectively filled with conductive ink to establish electrical connections between successive coil patterns.

8. An electrical coil as recited in claim 1, wherein every other coil pattern winds clockwise from the outer end to the inner end thereof, and wherein each remaining coil pattern winds clockwise from the inner end thereof to the outer end thereof so that there is a common coil winding direction throughout the stack.

9. An electrical coil as recited in claim 1, wherein each of the substrates is identical.

10. An electrical coil as recited in claim 1, wherein at least two of the coil patterns differ from one another.

11. An electrical coil comprising:

a stack of coil layers, wherein at least two of the coil layers each include:

a layer substrate with an electrically conductive coil pattern thereon, wherein each coil pattern includes an inner end at a first via through the substrate at a point radially inside the coil pattern, and an outer end at a second via through the substrate at a point radially outside the coil pattern;

wherein each of the coil layers is joined to the stack with successive coil patterns connected to one another through the vias to form a conductive coil extending through the stack; and wherein each layer substrate has a plurality of first vias and a plurality of second vias, wherein each substrate layer is identical, and wherein the coil patterns vary from coil layer to coil layer with respect to at least one of: the inner end of the coil pattern being located at a different one of the first vias of its substrate with each successive pair of coil layers, or the outer end of the coil pattern being located at a different one of the second vias of its substrate with each successive pair of the coil layers, so no two pairs of coil layers are short circuited to one another through the vias.

12. An electrical coil comprising:

a stack of coil layers, wherein at least two of the coil layers each include:

a layer substrate with an electrically conductive coil pattern thereon, wherein each coil pattern includes an inner end at a first via through the substrate at a point inside the coil pattern, and an outer end at a second via through the substrate at a point outside the coil pattern;

wherein each of the coil layers is joined to the stack with successive coil patterns connected to one another through the vias to form a conductive coil extending through the stack, wherein each successive pair of outer vias are joined to one another at a respective outer via location that is varied from pair to pair in the stack of coil layers so no two pairs of coil layers are short circuited to one another through the vias.

13. An electrical coil as recited in claim 12, wherein for each successive pair of coil layers, the coil patterns connect to each other by at least one of the first vias of each of the coil layers in the pair or the second vias of each of the coil layers in the pair.

14. An electrical coil as recited in claim 12, wherein each conductive coil pattern includes conductive ink, heat treated for electrical conductivity.

15. An electrical coil as recited in claim 12, wherein the layer substrates include a ceramic material.

16. An electrical coil as recited in claim 12, wherein each layer substrate is 20 microns or less in thickness.

17. An electrical coil as recited in claim 12, wherein 80% or more of the volume of the stack is occupied by the coil patterns.

18. An electrical coil as recited in claim 12, wherein the vias are respectively filled with conductive ink to establish electrical connections between successive coil patterns.

19. An electrical coil as recited in claim 12, wherein successive pairs of inner vias are joined at a first inner via location that is different with each successive pair.

* * * * *